US006874451B2

(12) United States Patent
Matsutani et al.

(10) Patent No.: US 6,874,451 B2
(45) Date of Patent: Apr. 5, 2005

(54) COOLING APPARATUS OF AN INTERNAL COMBUSTION ENGINE

(75) Inventors: Takashi Matsutani, Toyota (JP); Yoshikazu Shinpo, Nissin (JP); Takanori Nakada, Toyota (JP); Yasuki Hashimoto, Okazaki (JP); Makoto Hatano, Obu (JP); Katsunori Ueda, Toyota (JP)

(73) Assignees: Toyota Jidosha Kabushiki Kaisha, Toyota (JP); Aisan Kogyo Kabushiki Kaisha, Obu (JP); Nichias Corporation, Tokyo (JP)

( * ) Notice: Subject to any disclaimer, the term of this patent is extended or adjusted under 35 U.S.C. 154(b) by 123 days.

(21) Appl. No.: 10/452,639

(22) Filed: Jun. 3, 2003

(65) Prior Publication Data

US 2003/0230253 A1 Dec. 18, 2003

(30) Foreign Application Priority Data

Jun. 12, 2002 (JP) ..... 2002-171905

(51) Int. Cl.[7] ..... F02F 1/14
(52) U.S. Cl. ..... 123/41.79
(58) Field of Search ..... 123/41.74, 41.72, 123/41.57, 41.67, 41.15, 41.79

(56) References Cited

U.S. PATENT DOCUMENTS 4,253,431 A 3/1981 Mettig et al.
6,581,550 B2 * 6/2003 Shinpo et al. ..... 123/41.74

FOREIGN PATENT DOCUMENTS

| | | |
|---|---|---|
| DE | 24 33 813 | 6/1975 |
| DE | 40 29 427 A1 | 4/1991 |
| DE | 101 02 644 C1 | 2/2002 |
| GB | 1012082 | 12/1965 |
| JP | 57-43338 | 12/1982 |
| JP | A 63-272950 | 11/1988 |
| JP | A8-296495 | 11/1996 |
| JP | A-9-88713 | 3/1997 |

OTHER PUBLICATIONS

U.S. Appl. No. 09/891,402, filed Jun. 27, 2001, Shinpo et al.

* cited by examiner

*Primary Examiner*—Andrew M. Dolinar
*Assistant Examiner*—Katrina B. Harris
(74) *Attorney, Agent, or Firm*—Oliff & Berridge, PLC

(57) ABSTRACT

A cooling apparatus of an internal combustion engine includes an insert that is deformable, and a surface of the insert opposing a cylinder bore wall is close to the cylinder bore wall after the insert is inserted into a water jacket. A cooling apparatus of an internal combustion engine includes a cylinder block having a water jacket in which an insert is disposed; the cylinder block is machined so that a water hole or an aperture having a size corresponding to a size of the insert is formed in the cylinder block and the insert can be inserted into the water jacket through the water hole or the aperture.

16 Claims, 4 Drawing Sheets

COOLING APPARATUS OF AN INTERNAL COMBUSTION ENGINE

BACKGROUND OF THE INVENTION

1. Field of Invention

The present invention relates to a cooling apparatus of an internal combustion engine, and includes not only the cooling apparatus but also an insert disposed in a water jacket of the engine and a cylinder block of the engine.

2. Description of Related Art

In an internal combustion engine, a water jacket is formed around cylinder bores in a cylinder block, and engine cooling water is caused to flow in the water jacket to cool the engine which is heated due to combustion and sliding of a piston. A temperature of a cylinder bore wall is likely to be higher at an upper portion of the cylinder bore wall than at a lower portion of the cylinder bore wall. Therefore, if the cooling water is caused to flow uniformly at an upper portion and a lower portion of the water jacket for preventing the temperature of the upper portion of the cylinder bore wall from being too high, the lower portion of the cylinder bore will be over-cooled, resulting in an increase in a friction loss generated in the sliding of the piston with the cylinder bore.

In order to improve a temperature distribution in the cylinder bore wall, Japanese Utility Model Publication SHO 57-43338 discloses that an insert is disposed in a water jacket. By providing the insert in the water jacket, a heat removed from the cylinder bore wall can be controlled. More particularly, at a portion where the insert is provided, a flow amount is decreased and the temperature of the cylinder bore wall is maintained high (i.e., less of a cooling effect takes place). By the heat control, the temperature distribution of the cylinder bore wall is improved.

In order to insert the insert into the water jacket, in a cylinder block of a closed deck-type, it is conceivable to insert the insert through a water hole formed in an upper deck of the cylinder block.

However, in the closed deck-type cylinder block, the water hole is small due to a structure of a core used in casting and is discontinuous in an extending direction of the water jacket. As a result, a size of the insert is also small, and a clearance between the insert and the cylinder bore wall is large. The insert also is discontinuous in the extending direction of the water jacket. Therefore, a heat amount removed from the cylinder bore wall is large, and the cylinder bore wall is still over-cooled.

SUMMARY OF THE INVENTION

An object of the invention is to provide a cooling apparatus of an internal combustion engine, an insert and a cylinder block, capable of suppressing a heat amount removed from a cylinder bore wall.

The above object can be performed by the following cooling apparatus of an internal combustion engine, insert and cylinder block according to aspects of the present invention.

A cooling apparatus of an internal combustion engine according to one aspect of the invention includes a closed deck-type cylinder block and an insert. The closed deck-type cylinder block has a water jacket formed therein for causing engine cooling water to flow therein to cool the engine, and a cylinder bore wall and an upper deck including a water hole formed therein. The insert is disposed in the water jacket and has a surface opposing the cylinder bore wall. The insert is deformable and is inserted into the water jacket through the water hole. The insert is deformed after being inserted into the water jacket such that the surface of the insert is close to the cylinder bore wall.

According to one embodiment, the surface of the insert contacts the cylinder bore wall after the insert is inserted into the water jacket.

According to one embodiment, the insert is deformed after being inserted into the water jacket such that the insert is increased in size in a width direction of the insert.

A cooling apparatus of an internal combustion engine according to another aspect of the invention includes a closed deck-type cylinder block and an insert, wherein the closed deck-type cylinder block has a water jacket formed therein for causing engine cooling water to flow therein to cool the engine, and an upper deck including a water hole formed therein. The insert is disposed in the water jacket. The upper deck is machined so that the water hole has a size corresponding to a size of the insert. The insert is inserted into the water jacket through the water hole.

A cooling apparatus of an internal combustion engine according to another aspect of the invention includes a closed deck-type cylinder block and an insert, wherein the closed deck-type cylinder block has a water jacket formed therein for causing engine cooling water to flow therein to cool the engine and a water jacket wall. The insert is disposed in the water jacket. The water jacket wall is machined so that an aperture having a size corresponding to a size of the insert is formed in the water jacket wall. The insert is inserted into the water jacket through the aperture formed in the water jacket wall.

According to another aspect of the invention, an insert is used in a closed deck-type cylinder block including a water jacket formed therein, a cylinder bore wall, an upper deck and a water hole formed in the upper deck. The insert is disposed in the water jacket and is inserted into the water jacket through the water hole. The insert includes a surface opposing the cylinder bore wall. The insert is deformable, and the surface of the insert is close to the cylinder bore wall after the insert is inserted into the water jacket.

According to one embodiment, the surface of the insert contacts the cylinder bore wall after the insert is inserted into the water jacket.

According to one embodiment, the insert is deformed after being inserted into the water jacket such that the insert is increased in size in a width direction of the insert.

A cylinder block of a closed deck-type according to another aspect of the invention includes a water jacket and an upper deck, wherein the water jacket is formed in the cylinder block, and an insert is disposed in the water jacket. The upper deck has a water hole formed in the upper deck. The upper deck is machined so that the water hole has a size corresponding to a size of the insert. The insert is inserted into the water jacket through the water hole.

A cylinder block of a closed deck-type according to another aspect of the invention includes a water jacket and a water jacket wall, wherein the water jacket is formed in the cylinder block, and an insert is disposed in the water jacket. The water jacket wall is machined so that an aperture having a size corresponding to a size of the insert is formed in the water jacket wall. The insert is inserted into the water jacket through the aperture formed in the water jacket wall.

In the cooling apparatus and insert of an internal combustion engine according to preferred embodiments, a clearance between the insert and the cylinder bore wall is made small or zero, so that an amount of heat removed from the cylinder bore wall is small.

In the cooling apparatus and insert of an internal combustion engine according to preferred embodiments, a space between adjacent inserts is small, so that an amount of heat removed from the cylinder bore wall is small.

In the cooling apparatus and cylinder block of an internal combustion engine according to preferred embodiments, since the upper deck is only machined so that the water hole has a size corresponding to the size of the insert, a large change does not need to be made in manufacture of the cylinder block.

In the cooling apparatus and cylinder block of an internal combustion engine according to preferred embodiments, an, insert continuous in the extending direction of the water jacket can be used, so that an amount of heat removed from the cylinder bore wall is small.

BRIEF DESCRIPTION OF THE DRAWINGS

The above and other objects, features, and advantages of the present invention will become apparent and will be more readily appreciated from the following detailed description of exemplary embodiments of the present invention in conjunction with the accompanying drawings, in which.

DETAILED DESCRIPTION OF PREFERRED EMBODIMENTS

Figure 1:
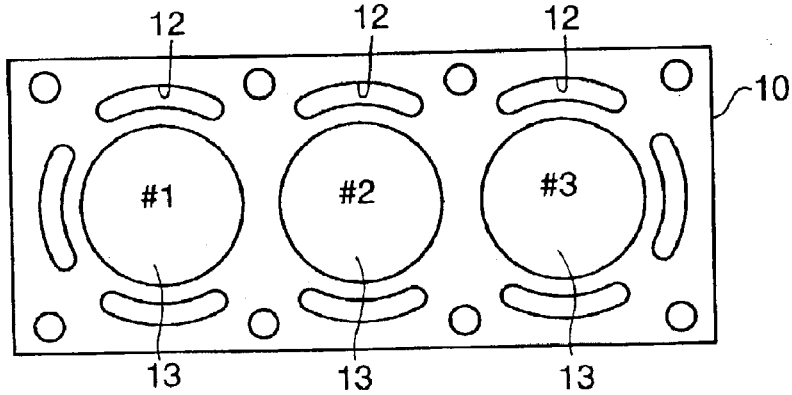
FIG. 1 is a plan view of a cooling apparatus of an internal combustion engine, an insert and a cylinder block applicable to any embodiment of the present invention.

A cooling apparatus of an internal combustion engine, an insert and a cylinder block according to the present invention will be explained with reference to FIGS. 1–12. FIGS. 2 and 3 illustrate an apparatus according to a first embodiment of the present invention. FIGS. 4–12 illustrate an apparatus according to second-tenth embodiments of the present invention, respectively.

Portions having the same or similar structures over the first through tenth embodiments of the present invention are denoted with the same reference numerals over the first through tenth embodiments of the present invention.

First, the portions having the same or similar structures over the first through tenth embodiments of the present invention will be explained with reference to FIGS. 1–3.

A cooling apparatus of an internal combustion engine according to the present invention includes a cylinder block 10 and an insert 1. The cylinder block 10 is a closed deck-type cylinder block. The cylinder block 10 has a water jacket 11 continuously extending around cylinder bores 13 and a cylinder bore wall 14. The cylinder block 10 has an upper deck 10*a* and a plurality of water holes 12 formed in the upper deck 10*a*. The upper deck 10*a* includes a water hole portion 10*b* surrounding the water hole 12. The water holes 12 are formed discontinuously in the extending direction of the water jacket 11. The water hole 12 communicates with the water jacket 11. The water hole 12 is a hole through which engine cooling water flows from the water jacket 11 of the cylinder block 10 to a water jacket of a cylinder head.

The insert 1 includes a body 1*a*. The insert 1 may include a support 2 to which the body 1*a* is fixed. The body 1*a* of the insert 1 is disposed in the water jacket 11. The cylinder bore wall 14 has a portion downwardly distanced from a combustion chamber, which is desired to be prevented from being over-cooled. The body 1*a* of the insert 1 is disposed close to that portion which is to be prevented from over-cooling, of the cylinder bore wall 14 such that the body 1*a* of the insert 1 contacts or is slightly spaced from an outer surface of that portion. The insert 1 minimizes or regulates the flow amount of the cooling water between the insert and that portion of the cylinder bore wall so that that portion of the cylinder bore wall 14 is not over-cooled. The body 1*a* of the insert 1 has a surface opposing the cylinder bore wall 14. The insert 1 is constructed such that the surface opposing the cylinder bore wall, of the body 1*a* of the insert 1 is brought into contact or is close to the cylinder bore wall 14 after the insert 1 has been inserted into the water jacket 11.

In order to insert the insert 1 into the water jacket 11, the water hole 12 formed in the upper deck 10*a* may be used, or an aperture temporarily formed in a side wall portion of the cylinder block and which is closed after insertion of the insert 1 into the water jacket 11 may be used. Such hole or aperture used for inserting the insert 1 into the water jacket 11 has a size corresponding to a size of the insert 1, namely, a size to allow the insert 1 to pass through the hole or the aperture.

When the insert 1 is inserted into the water jacket 11 through the water hole 12, a transverse cross section of the insert 1 is smaller than the size of the water hole 12, while after the insert 1 has been inserted in the water jacket 11, the insert 1 is deformed to be larger in size than that size at the time of the insertion of the insert 1 into the water jacket 11. Due to the deformation, a clearance between the insert 1 and the cylinder bore wall 14 is decreased, or the insert 1 is brought into contact with the cylinder bore wall 14. As a result, the cooling water is prevented from flowing much between the insert 1 and the cylinder bore wall 14, so that the cylinder bore wall 14 is prevented from being over-cooled.

When the inserts 1 are inserted into the water jacket 11 through the water hole 12, a space between adjacent inserts 1 in the extending direction of the water jacket 11 is smaller than a space between adjacent water holes 12 in the extending direction of the water jacket 11, while after the inserts 1 have been inserted into the water jacket 11, the inserts 1 including the support 2 may be deformed such that the space between adjacent inserts in the extending direction of the water jacket 11 is smaller than the space at the time of the insertion of the inserts 1 into the water jacket 11. Due to the deformation, the inserts 1 are increased in width and the space between the inserts 1 is decreased in the extending direction of the water jacket 11, so that the amount of heat removed from the cylinder bore wall 14 is decreased and the cylinder bore wall 14 is prevented from being over-cooled.

A mere insertion of the insert 1 into water jacket 11 could not decrease a clearance between the insert 1 and the cylinder bore wall 14 and a space between the adjacent inserts 1. However, in the present invention, decreasing a clearance between the insert 1 and the cylinder bore wall 14 and/or a space between the adjacent inserts 1 is possible by providing the following structures of respective embodiments of the present invention.

Next, the structures of each embodiment of the present invention and the effects thereof will be explained below.

Figure 2:
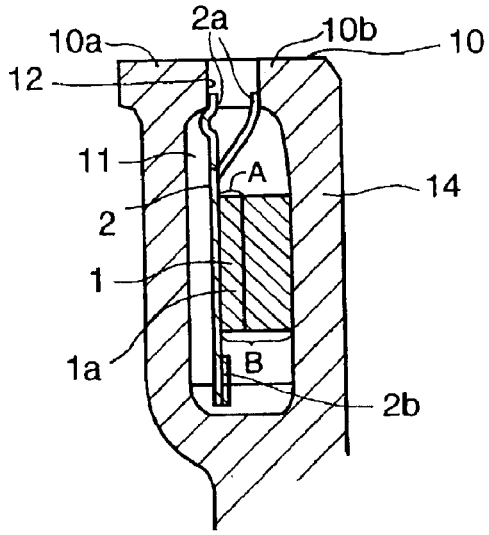
FIG. 2 is a cross-sectional view of a cooling apparatus of an internal combustion engine and an insert according to a first embodiment of the present invention.
Figure 3A:
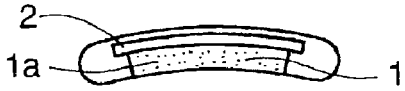
FIG. 3A is a plan view of the cooling apparatus of an internal combustion engine and the insert according to the first embodiment of the present invention.
Figure 3B:
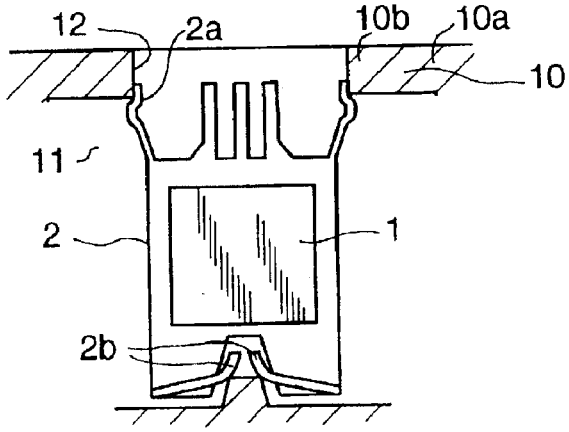
FIG. 3B is a side elevational view of the cooling apparatus of an internal combustion engine and the insert according to the first embodiment of the present invention.

In the first embodiment of the present invention which relates to the cooling apparatus of an engine and the insert 1, as illustrated in FIGS. 1–3, the body 1*a* of insert 1 can be deformed in a thickness direction of the insert 1 after the insert 1 is inserted into the water jacket 11 so that the surface opposing the cylinder bore wall 14, of the body 1*a* of the insert 1 is close to or contacts the cylinder bore wall 14. The body 1*a* of the insert 1 has a feature of expanding in the thickness direction of the insert 1 by contacting water or LLC (long life coolant). The body 1*a* of the insert 1 may be constructed of, for example, a rubber foam which contains a binder and is compressed, so that when the rubber foam contacts water or LLC, the binder is dissolved and the rubber foam expands. When the water jacket is filled with water or LLC at the stage of engine assembly or vehicle assembly, as illustrated in FIG. 2, the size A (smaller than the size of the water hole) at the stage of insertion of the insert 1 changes to the size B (greater than the size of the water hole) at the stage after expansion of the body 1*a*. As a result, the body 1*a* of the insert 1 contacts the cylinder bore wall 14.

The body 1 of the insert 1 is demountably supported by the cylinder block 10 via the support 2 made from stainless steel, of the insert 1 due to the elasticity of an upper arm 2*a* and a lower arm 2*b*. By this supporting structure, the insert 1 is fixed in position even when a flow force of cooling water acts on the insert 1.

With an effect of the first embodiment of the present invention, since the insert 1 is maintained small in size when inserted through the water hole 12 into the water jacket 11, the insertion through the water hole 12 is easy, while since the body 1*a* of the insert 1 expands after the insertion, the insert 1 can be reliably fixed in position relative to the cylinder block 10. When the insert 1 is demounted from the cylinder block 10, the insert 1 is only pulled by a jig or the like. Since the insert 1 is deformed when passing through the water hole 12, the removal is easy. Therefore, the mounting and demounting feature of the insert 1 is good.

Figure 4:
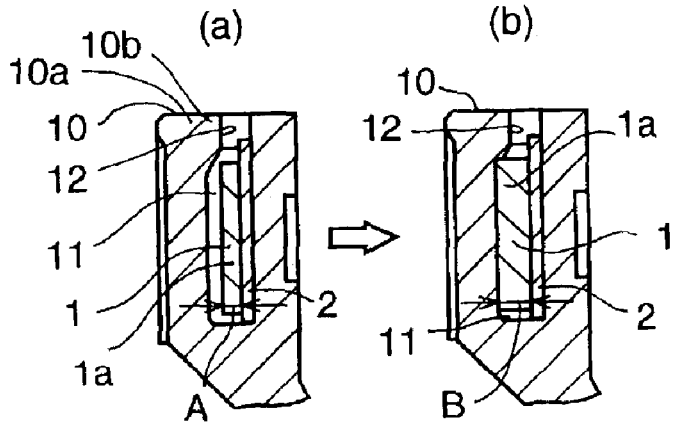
FIG. 4 is a cross-sectional view of a cooling apparatus of an internal combustion engine and an insert (a) before expansion of the insert and (b) after expansion of the insert, according to a second embodiment of the present invention.

In the second embodiment of the present invention which relates to the cooling structure of the internal combustion engine and the insert 1, as illustrated in FIG. 4, the body 1*a* of insert 1 can be deformed in a thickness direction of the insert 1 after the insert 1 is inserted into the water jacket 11 so that the surface opposing the cylinder bore wall 14, of the body 1*a* of the insert 1 is close to or contacts the cylinder bore wall 14. The body 1*a* of the insert 1 has a feature of expanding in the thickness direction of the insert 1 in response to temperature. The body 1*a* of the insert 1 may be constructed of, for example, a temperature responsive-type rubber foam, which may be replaced by a bimetal or a shape memory effect alloy. When the water jacket is filled with warmed water or warmed LLC at the stage of engine assembly or vehicle assembly, as illustrated in FIG. 4, the size of the body 1*a* of the insert 1 changes from size A (smaller than the size of the water hole) at the stage of insertion of the insert 1 to size B (greater than the size of the water hole) at the stage after expansion of the body 1*a*. As a result, the body 1*a* of the insert 1 contacts the cylinder bore wall 14.

With an effect of the second embodiment of the present invention, since the insert 1 is maintained small in size when inserted through the water hole 12 into the water jacket 11, the insertion through the water hole 12 is easy, while since the body 1*a* of the insert 1 expands in response to temperature after the insertion, the insert 1 can be reliably fixed in position relative to the cylinder block 10. When the insert 1 is demounted from the cylinder block 10, the insert 1 is only pulled by a jig or the like. Since the insert 1 is deformed when passing through the water hole 12, the removal is easy. Therefore, the mounting and demounting feature of the insert 1 is good.

Figure 5:
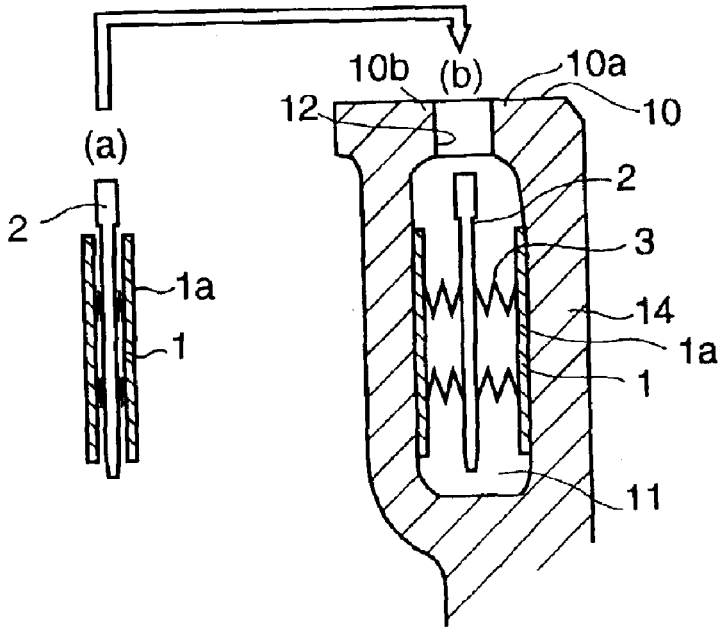
FIG. 5 is a cross-sectional view of a cooling apparatus of an internal combustion engine and an insert (a) before expansion of the insert and (b) after expansion of the insert, according to a third embodiment of the present invention.

In the third embodiment of the present invention which relates to the cooling structure of the internal combustion engine and the insert 1, as illustrated in FIG. 5, the body 1*a* of insert 1 is elastically supported by an elastic supporting mechanism, for example, a spring 3. The body 1*a* of the insert 1 is displaceable in a thickness direction of the insert 1 relative to the support 2 of the insert 1 in a direction toward and away from the support 2, and is biased by the spring 3 in the direction away from the support 2. The spring 3 forms a portion of the insert 1. Therefore, the insert 1 can be deformed after the insert 1 is inserted into the water jacket 11 so that the surface opposing the cylinder bore wall 14, of the body 1*a* of the insert 1 is close to or contacts the cylinder bore wall 14. When the insert 1 is inserted into the water jacket 11 through the water hole 12, the spring 3 is deformed to a closed state and fixed to the closed state by a binder or the like, and after the insert 1 is inserted into the water jacket 11 and the binder is dissolved by the water or LLC in the water jacket 11 the body 1*a* is displaced away from the support 2 by the spring 3 and is brought into contact with or is close to the water jacket wall including the cylinder bore wall 14. As a result, the insert 1 including the support 2 and the spring 3 is fixed in position relative to the cylinder block 10.

With an effect of the third embodiment of the present invention, since the insert 1 is maintained small in size when inserted through the water hole 12 into the water jacket 11, the insertion through the water hole 12 is easy, while since the body 1*a* is biased by the spring 3 and is displaced toward the water jacket wall after the insert 1 is inserted in the water jacket 11, the insert 1 can be reliably fixed in position relative to the cylinder block 10. When the insert 1 is demounted from the cylinder block 10, the insert 1 is only pulled by a jig or the like. Since the insert 1 is deformed when passing through the water hole 12, the removal is easy. Therefore, the mounting and demounting feature of the insert 1 is good.

Figure 6:
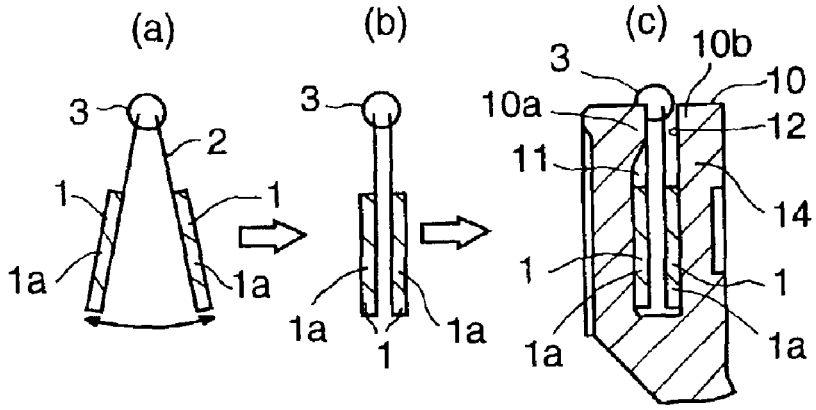
FIG. 6 is a cross-sectional view of a cooling apparatus of an internal combustion engine and an insert (a) when the insert is free, (b) when the insert is closed, and (c) when the insert is open, according to a fourth embodiment of the present invention.

In the fourth embodiment of the present invention which relates to the cooling structure of the internal combustion engine and the insert 1, as illustrated in FIG. 6, the support 2 has two arms to which the body 1*a* of the insert 1 is fixed. The arms of the support 2 are pivotally coupled to each other so as to be movable in a thickness direction of the insert 1 and are biased by a torsion spring 3 in a direction away from each other. The spring 3 is a portion of the insert 1. When the insert 1 is inserted into the water jacket 11 through the water hole 12, the two arms of the support 2 are closed from an open state (state (a) of FIG. 6) to a shrinkage state (state (b) of FIG. 6), and after the insert 1 is inserted into the water jacket 11, the two arms of the support 2 open to an open state (state (c) of FIG. 6) by the biasing force of the spring 3, so that the bodies 1*a* are brought into contact with or are close to the water jacket wall including the cylinder bore wall 14. As a result, the insert 1 including the support 2 and the spring 3 is fixed in position relative to the cylinder block 10.

With an effect of the fourth embodiment of the present invention, since the insert 1 is maintained small in size when inserted through the water hole 12 into the water jacket 11, the insertion through the water hole 12 is easy, while since the bodies 1*a* are biased by the spring 3 and are displaced toward the water jacket wall after the insert 1 is inserted in the water jacket 11, the insert 1 can be reliably fixed in position relative to the cylinder block 10. When the insert 1 is demounted from the cylinder block 10, the insert 1 is only pulled by a jig or the like. Since the insert 1 is deformed when passing through the water hole 12, the removal is easy. Therefore, the mounting and demounting feature of the insert 1 is good.

Figure 7:
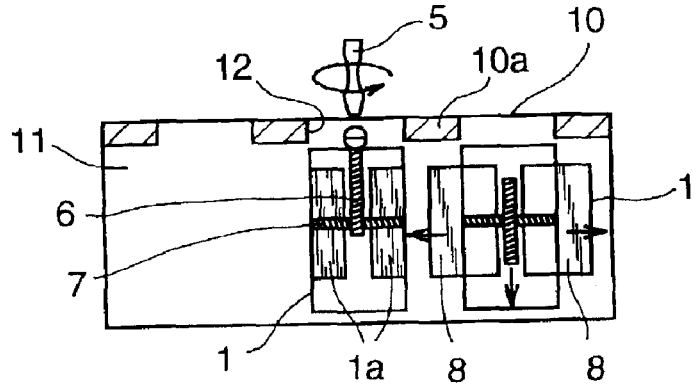
FIG. 7 is a side elevational view of a cooling apparatus of an internal combustion engine and an insert according to a fifth embodiment of the present invention.

In the fifth embodiment of the present invention which relates to the cooling structure of the internal combustion engine and the insert 1, as illustrated in FIG. 7, the insert 1 is deformable in a width direction of the insert 1 which corresponds to the extending direction of the water jacket 11. Before the insert 1 is inserted into the water jacket 11, each insert 1 has a width smaller than a length of the water hole 12 in the extending direction of the water jacket 11, while after the insert 1 is inserted into the water jacket 11, the insert 1 is increased in width such that the insert 1 has a width greater than the length of the water hole 12. The insert 1 may be increased in thickness also. A width increasing mechanism of the insert 1 may be a mechanical one. FIG. 7 illustrates one example of such mechanical width increasing mechanism. The mechanism of FIG. 7 includes a first screw rod 6 and a second screw rod 7. The first screw rod 6 extends parallel to an axis of the cylinder bore and can be rotated about an axis of the rod 6 by a driver 5. The second screw rod 7 extends perpendicularly to the extending-direction of the first screw rod and is threaded with the first screw rod 6. The second screw rod 7 is threaded with a slidable portion 8 of the insert 1. When the first screw rod 6 is moved vertically, the second screw rod 7 is rotated about an axis of the second screw rod 7, and in turn the slidable portion 8 is driven perpendicularly to the extending direction of the first screw rod so that the width of the insert 1 changes. When the widths of adjacent inserts 1 are increased, a space between the adjacent inserts 1 is decreased. When finally the adjacent inserts 1 contact each other, the space between the adjacent inserts 1 becomes zero.

With an effect of the fifth embodiment of the present invention, since the insert 1 is maintained small in width when inserted through the water hole 12 into the water jacket 11, the insertion through the water hole 12 is easy, while since the insert 1 is increased in width after the insert 1 is inserted in the water jacket 11, the insert 1 can be reliably fixed in position relative to the cylinder block 10. When the insert 1 is demounted from the cylinder block 10, the insert 1 is only pulled by a jig or the like and the removal is easy. Therefore, the mounting and demounting feature of the insert 1 is good.

Figure 8:
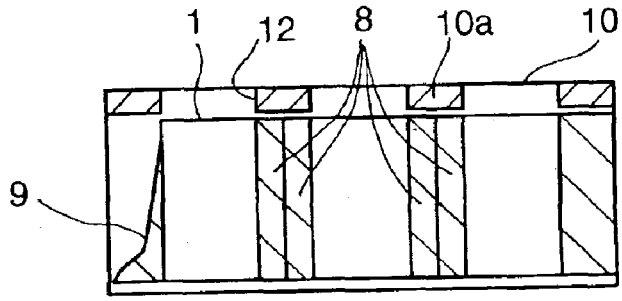
FIG. 8 is a side elevational view of a cooling apparatus of an internal combustion engine and an insert according to a sixth embodiment of the present invention.

In the sixth embodiment of the present invention which relates to the cooling structure of the internal combustion engine and the insert 1, as illustrated in FIG. 8, the insert 1 is deformable in a width direction of the insert 1 which corresponds to the extending direction of the water jacket 11. Before the insert 1 is inserted into the water jacket 11, each insert 1 has a width smaller than a length of the water hole 12 in the extending direction of the water jacket 11, while after the insert 1 is inserted into the water jacket 11, the insert 1 is increased in width such that the insert 1 has a width greater than the length of the water hole 12. The insert 1 may be increased in thickness also. The width increase may be caused by any of chemical reaction of at least one portion of the insert 1 with water or LLC, dissolution of a binder soaked in the insert 1 by water or LLC, and reaction of the insert 1 due to heat. In FIG. 8, the width increased portion is hatched and is denoted with reference number 8. FIG. 8 illustrates that the width-increased adjacent inserts 1 contact with each other so that a space between the adjacent inserts 1 is removed. In order to make a water introduction feature good, it is preferable that an upstream portion 9 of an upstream insert 1 is cut.

With an effect of the sixth embodiment of the present invention, since the insert 1 is maintained small in width when inserted through the water hole 12 into the water jacket 11, the insertion through the water hole 12 is easy, while since the insert 1 is increased in width after the insert 1 is inserted in the water jacket 11, the insert 1 can be reliably fixed in position relative to the cylinder block 10. When the insert 1 is demounted from the cylinder block 10, the insert 1 is only pulled by a jig or the like and the removal is easy. Therefore, the mounting and demounting feature of the insert 1 is good.

Figure 9:
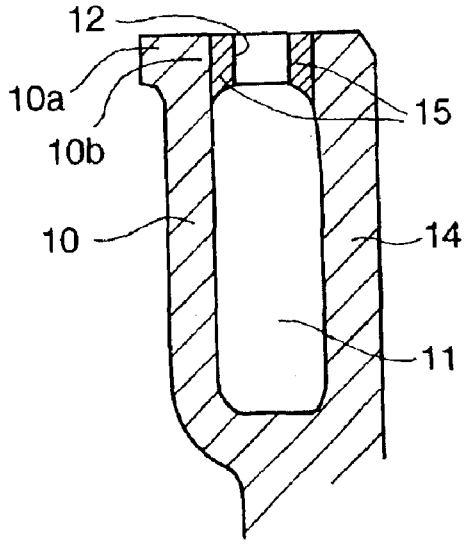
FIG. 9 is a cross-sectional view of a cooling apparatus of an internal combustion engine and a cylinder block according to a seventh embodiment of the present invention.

In the seventh embodiment of the present invention which relates to the cooling structure of the internal combustion engine and the cylinder block 10, as illustrated in FIG. 9, the cylinder block 10 is of a closed deck-type and the water hole 12 is formed in the water hole portion 10*b* of the upper deck 10*a* of the cylinder block 10. The water hole portion 10*b* of the upper deck 10*a* is machined such that the water hole 12 has a size corresponding to a size of the insert 1 in the width direction of the water hole 12 (which corresponds to the thickness direction of the insert 1). More particularly, when the size of the insert 1 is greater than a normal size of the insert 1, and therefore, when a size of the water hole 12 of a cast cylinder block is smaller than the size of the insert 1 to be inserted into the water jacket 11, the cast cylinder block is machined so that the water hole 12 has a size greater than the size of the insert 1. The portion of the water hole portion 10*b* of the upper deck 10*a* removed by machining is denoted with reference 15 in FIG. 9. By the machining, the insert 1 having a greater size than the normal size can be inserted into the water jacket 11 through the water hole 12. As a result, a clearance between the insert 1 and the cylinder bore wall 14 can be decreased. The size-increased water hole 12 may be left as it is, and does not need to be narrowed to an original size.

With an effect of the seventh embodiment of the present invention, since the size of the water hole 12 is widened so as to have a size corresponding to the size of the insert 1, the insertion of the insert 1 into the water jacket 11 through the water hole 12 is easy, while since the insert 1 having a greater size than the normal insert can be used, the insert 1 can be reliably fixed in position relative to the cylinder block 10. When the insert 1 is demounted from the cylinder block 10, the insert 1 is only pulled by a jig or the like and the removal is easy. Therefore, the mounting and demounting feature of the insert 1 is good. Further, machining is conducted for widening the water hole 12 only and there is no substantial change in production of the cylinder block.

Figure 10:
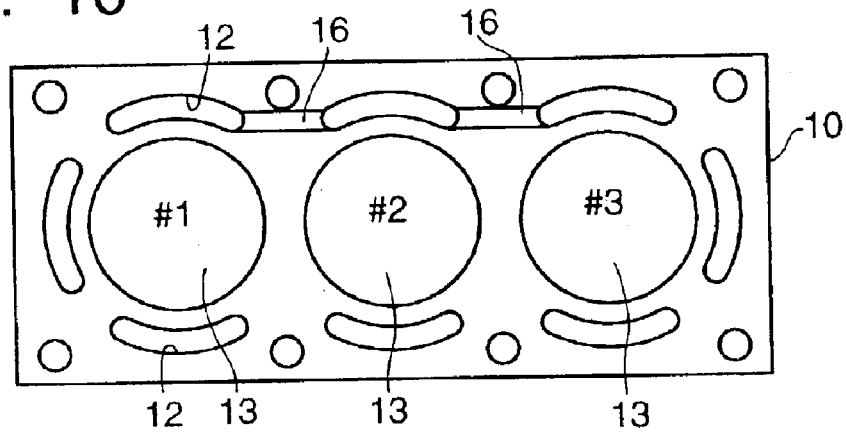
FIG. 10 is a plan view of a cooling apparatus of an internal combustion engine and a cylinder block according to an eighth embodiment of the present invention.

In the eighth embodiment of the present invention which relates to the cooling structure of the internal combustion engine and the cylinder block 10, as illustrated in FIG. 10, the cylinder block 10 is of a closed deck-type and the water hole 12 is formed in the water hole portion 10*b* of the upper deck 10*a* of the cylinder block 10. The water hole portion 10*b* of the upper deck 10*a* is machined such that the water hole 12 has a size corresponding to a size of the insert 1 in the longitudinal direction of the water hole 12 (which corresponds to the width direction of the insert 1). More particularly, when the insert 1 is a single integral one extending continuously in the extending direction of the water jacket 11, a portion between adjacent-water holes 12, of the upper deck 10*a* of the cylinder block 10 is removed by machining so that the water holes 12 are integral with each other to construct a single water hole extending continuously in the extending direction of the water jacket 11. The portion removed by machining is denoted with reference numeral 16. The continuous insert 1 is inserted through the continuous water hole 12 into the water jacket 11.

With an effect of the eighth embodiment of the present invention, since the water hole 12 is continuous in the extending direction of the water jacket 11, the insert 1 continuous in the extending direction of the water jacket 11 can be inserted into the water jacket 11 through the water hole 12. Further, since the insert 1 is continuous, the insert 1 can be reliably fixed in position relative to the cylinder block 10. When the insert 1 is demounted from the cylinder block 10, the insert 1 is only pulled by a jig or the like and the removal is easy. Therefore, the mounting and demounting feature of the insert 1 is good. Further, machining is for lengthening the water holes 12 to an integral one, and there is no substantial change in production of the cylinder block.

Figure 11:
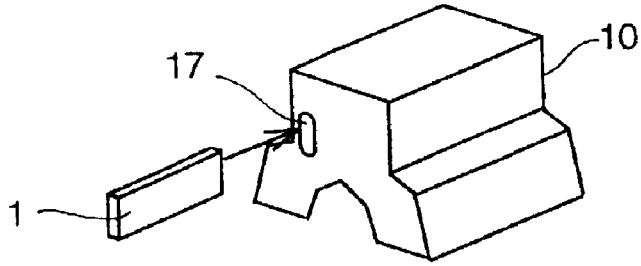
FIG. 11 is a perspective view of a cooling apparatus of an internal combustion engine and a cylinder block according to a ninth embodiment of the present invention.

In the ninth embodiment of the present invention which relates to the cooling structure of the internal combustion engine and the cylinder block 10, as illustrated in FIG. 11, the cylinder block 10 is of a closed deck-type having a water jacket 11 surrounded by a water jacket wall. The insert 1 is disposed in the water jacket 11. In the water jacket wall, an aperture 17 of a size corresponding to the size of the insert 1 is formed for inserting the insert 11 into the water jacket 11. In the embodiment shown in FIG. 11, the aperture 17 is formed in a front wall portion of the water jacket wall by utilizing a conventional water inlet of the cylinder block connected to a water pump of the engine and adding a slight machining to the water inlet. The insert 1 is inserted into the water jacket 11 through the aperture 17. Though the water jacket 11 is wavy (undulating), by using a deformable insert such as a rubber foam insert, the insert 1 can be conformed to the undulations of the water jacket 11 and can be easily inserted into the water jacket 11.

With an effect of the ninth embodiment of the present invention, since the aperture 17 is formed in the water jacket wall, an integral insert 1 extending continuously in the extending direction of the water jacket 11 can be used and can be easily inserted into the water jacket 11 through the aperture 17. Further, since the insert 1 is continuous, the insert 1 can be reliably fixed in position relative to the cylinder block 10. When the insert 1 is demounted from the cylinder block 10, the insert 1 is only pulled by a jig or the like and the removal is easy. Therefore, the mounting and demounting feature of the insert 1 is good. Further, since the aperture 17 can be formed only by adding a slight machining to the water inlet, there is no substantial change in production of the cylinder block.

Figure 12:
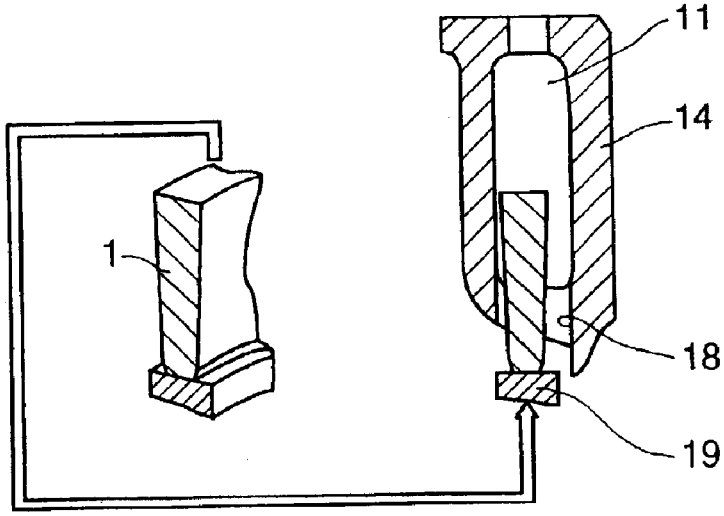
FIG. 12 is a cross-sectional view of a cooling apparatus of an internal combustion engine and a cylinder block according to a tenth embodiment of the present invention.

In the tenth embodiment of the present invention which relates to the cooling structure of the internal combustion engine and the cylinder block 10, as illustrated in FIG. 12, the cylinder block 10 is of a closed deck-type having a water jacket 11 surrounded by a water jacket wall. The insert 1 is disposed in the water jacket 11. In the water jacket wall, a temporary aperture 18 having a size corresponding to the size of the insert 1 is formed for inserting the insert 11 into the water jacket 11, and after the insert 1 is inserted into the water jacket 11, the temporary aperture 18 is closed by a plug 19. In the embodiment shown in FIG. 12, the aperture 18 is particularly formed in a bottom wall portion of the water jacket wall. The insert 1 is inserted into the water jacket 11 through the aperture 18. Though the water jacket 11 is wavy, by forming the insert 1 and the aperture 18 so as to have the same undulating configuration as that of the water jacket 11, the insert 1 can be inserted into the water jacket 11 through the aperture.

With an effect of the tenth embodiment of the present invention, even if an integral insert 1 extending continuously in the extending direction of the water jacket 11 is used, the insert 1 can be easily inserted into the water jacket 11 through the aperture 18 by forming the aperture 18 so as to extend continuously in the extending direction of the water jacket 11. In the case where the insert 1 extends continuously in the extending direction of the water jacket 11, the insert 1 can be reliably fixed in position relative to the cylinder block 10. Therefore, the mounting feature of the insert 1 is good. Further, since the aperture 18 only is formed in the bottom wall portion of the water jacket wall, a substantial change does not need to be made to a production of the cylinder block.

The following technical advantages are obtained by the invention.

According to the cooling apparatus of an internal combustion engine and the insert of any of the first through fourth embodiments of the present invention, a clearance between the insert and the cylinder bore wall can be made small or zero, so that an amount of heat removed from the cylinder bore wall is small.

According to the cooling apparatus of an internal combustion engine and the insert of any of the fifth and sixth embodiments of the present invention, a space between adjacent inserts is small, so that an amount of heat removed from the cylinder bore wall is small.

According to the cooling apparatus of an internal combustion engine and the cylinder block of any of the seventh and eighth embodiments of the present invention, since the upper deck is only machined so that the water hole has a size corresponding to the size of the insert, a large change does not need to be made in production of the cylinder block.

According to the cooling apparatus of an internal combustion engine and the cylinder block of any of the ninth and tenth embodiments of the present invention, an insert continuous in the extending direction of the water jacket can be used, so that an amount of heat removed from the cylinder bore wall is small.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A cooling apparatus of an internal combustion engine comprising:

a closed deck-type cylinder block having a water jacket formed therein for allowing engine cooling water to flow therein to cool the engine, the cylinder block having a cylinder bore wall and an upper deck including a water hole; and an insert disposed in the water jacket and having a surface opposing the cylinder bore wall, wherein the insert is deformable and is inserted into the water jacket through the water hole, the insert increasing size in at least one dimension after being inserted into the water jacket, such that after insertion into the water jacket, the insert is larger than the water hole in the at least one dimension.

2. An apparatus according to claim 1, wherein the surface of the insert contacts the cylinder bore wall after the insert is inserted into the water jacket.

3. An apparatus according to claim 1, wherein the at least one dimension in which the insert increases in size is a width direction of the insert.

4. An apparatus according to claim 1, wherein the at least one dimension in which the insert increases in size is a thickness direction of the insert.

5. An apparatus according to claim 1, wherein the insert is made from a material that increases in volume by absorbing liquid, and the insert increases in size by absorbing liquid after insertion into the water jacket.

6. An apparatus according to claim 1, wherein the insert is made from a material that increases in size by a change in temperature, and the insert increases in size by having its temperature changed after insertion into the water jacket.

7. An apparatus according to claim 1, wherein the insert includes an elastic member that causes the insert to increase in size after insertion into the water jacket.

8. A cooling apparatus of an internal combustion engine comprising:

a closed deck-type cylinder block having a water jacket formed therein for allowing engine cooling water to flow therein to cool the engine and having a water jacket wall; and an insert disposed in the water jacket, wherein the water jacket wall is machined so that temporary aperture having a size corresponding to a size of the insert is formed in the water jacket wall, the insert being inserted into the water jacket through the temporary aperture formed in the water jacket wall, and further comprising a plug inserted into the temporary aperture after insertion of the insert into the water jacket, the plug closing the temporary aperture.

9. An insert for use in a closed deck-type cylinder block including a water jacket formed therein, a cylinder bore wall, an upper deck and a water hole formed in the upper deck, the insert being disposed in the water jacket and being inserted into the water jacket through the water hole, the insert comprising:

a surface opposing the cylinder bore wall, wherein the insert is deformable and the insert increases in size in at least one dimension after being inserted into the water jacket, such that after insertion into the water jacket, the insert is larger than the water hole in the at least one dimension.

10. An insert according to claim 9, wherein the surface of the insert contacts the cylinder bore wall after the insert is inserted into the water jacket.

11. An insert according to claim 9, wherein the at least one dimension in which the insert increases in size is a width direction of the insert.

12. An insert according to claim 9, wherein the at least one dimension in which the insert increases in size is a thickness direction of the insert.

13. An insert according to claim 9, wherein the insert is made from a material that increases in volume by absorbing liquid, and the insert increases in size by absorbing liquid after insertion into the water jacket.

14. An insert according to claim 9, wherein the insert is made from a material that increases in size by a change in temperature, and the insert increases in size by having its temperature changed after insertion into the water jacket.

15. An insert according to claim 9, wherein the insert includes an elastic member that causes the insert to increase in size after insertion into the water jacket.

16. A cylinder block of a closed deck-type comprising:

a water jacket formed in the cylinder block, an insert being disposed in the water jacket; and a water jacket wall, wherein the water jacket wall is machined so that temporary aperture having a size corresponding to a size of the insert is formed in the water jacket wall, the insert being inserted into the water jacket through the temporary aperture formed in the water jacket wall, and further comprising a plug inserted into the temporary aperture after insertion of the insert into the water jacket, the plus closing the temporary aperture.

* * * * *